US005849421A

United States Patent [19]

Stephan

[11] Patent Number: 5,849,421

[45] Date of Patent: Dec. 15, 1998

[54] FOIL CUTS

[75] Inventor: Carl Wilfred Benjamin Stephan, Gordon's Bay, South Africa

[73] Assignee: Xpurrt Limited, St. Hellier, Channel Islands

[21] Appl. No.: 714,038

[22] PCT Filed: Mar. 3, 1995

[86] PCT No.: PCT/US95/02532

§ 371 Date: Dec. 30, 1996

§ 102(e) Date: Dec. 30, 1996

[87] PCT Pub. No.: WO95/23535

PCT Pub. Date: Sep. 8, 1995

[30] Foreign Application Priority Data

Mar. 3, 1994 [ZA] South Africa ..... 94/1494

[51] Int. Cl.[6] ..... A45D 19/18

[52] U.S. Cl. ..... 428/603; 428/606; 132/270

[58] Field of Search ..... 428/603, 606, 428/636; 132/208, 222, 270

[56] References Cited

U.S. PATENT DOCUMENTS

| | | | |
|---|---|---|---|
| 2,290,608 | 7/1942 | Evans | 428/603 |
| 4,184,002 | 1/1980 | Reiniche et al. | 428/603 |
| 4,196,741 | 4/1980 | Minghenelli | 132/222 |
| 4,916,001 | 4/1990 | Whittenberger et al. | 428/593 |
| 4,923,216 | 5/1990 | Cedar | 428/603 |
| 5,056,539 | 10/1991 | Abramson | 132/270 |
| 5,287,864 | 2/1994 | Gallo | 132/208 |
| 5,349,970 | 9/1994 | Razzoug | 132/208 |

FOREIGN PATENT DOCUMENTS

| | | | |
|---|---|---|---|
| 3142942 | 7/1983 | Germany | 132/208 |

*Primary Examiner*—John J. Zimmerman
*Attorney, Agent, or Firm*—Hinkle & Associates, P.C.

[57] ABSTRACT

A foil cut 10 comprises a strip of metal foil having a series of spaced, parallel corrugations 18 which extends from one side edge of the foil to the other.

4 Claims, 1 Drawing Sheet

FOIL CUTS

BACKGROUND OF THE INVENTION

I. Field of the Invention

This invention relates to foil cuts.

II. Description of the Related Art

Foil cuts are strips of metal (usually aluminium) foil that are used in the hairdressing technique known as foil highlighting. Such a technique is, for example, described in my U.S. Pat. No. 5,152,306.

SUMMARY OF THE INVENTION

According to the present invention there is provided a foil cut which comprises a strip of metal foil having a pair of opposite end edges and a pair of opposite side edges, and a series of spaced, parallel corrugations which extend from one said side edge to the other.

The corrugations may be in a corrugated central portion of the foil cut, the foil cut further having uncorrugated portions between the corrugated portion and each said end edge.

The uncorrugated portions may be embossed.

Further according to the invention there is provided a pack which comprises a stack of foil cuts as aforesaid, stacked one on top of the other and enclosed in a container.

BRIEF DESCRIPTION OF THE DRAWINGS

The invention will now be described in more detail, by way of example, with reference to the accompanying drawings.

In the drawings.

DESCRIPTION OF THE PREFERRED EMBODIMENTS

Figure 1:
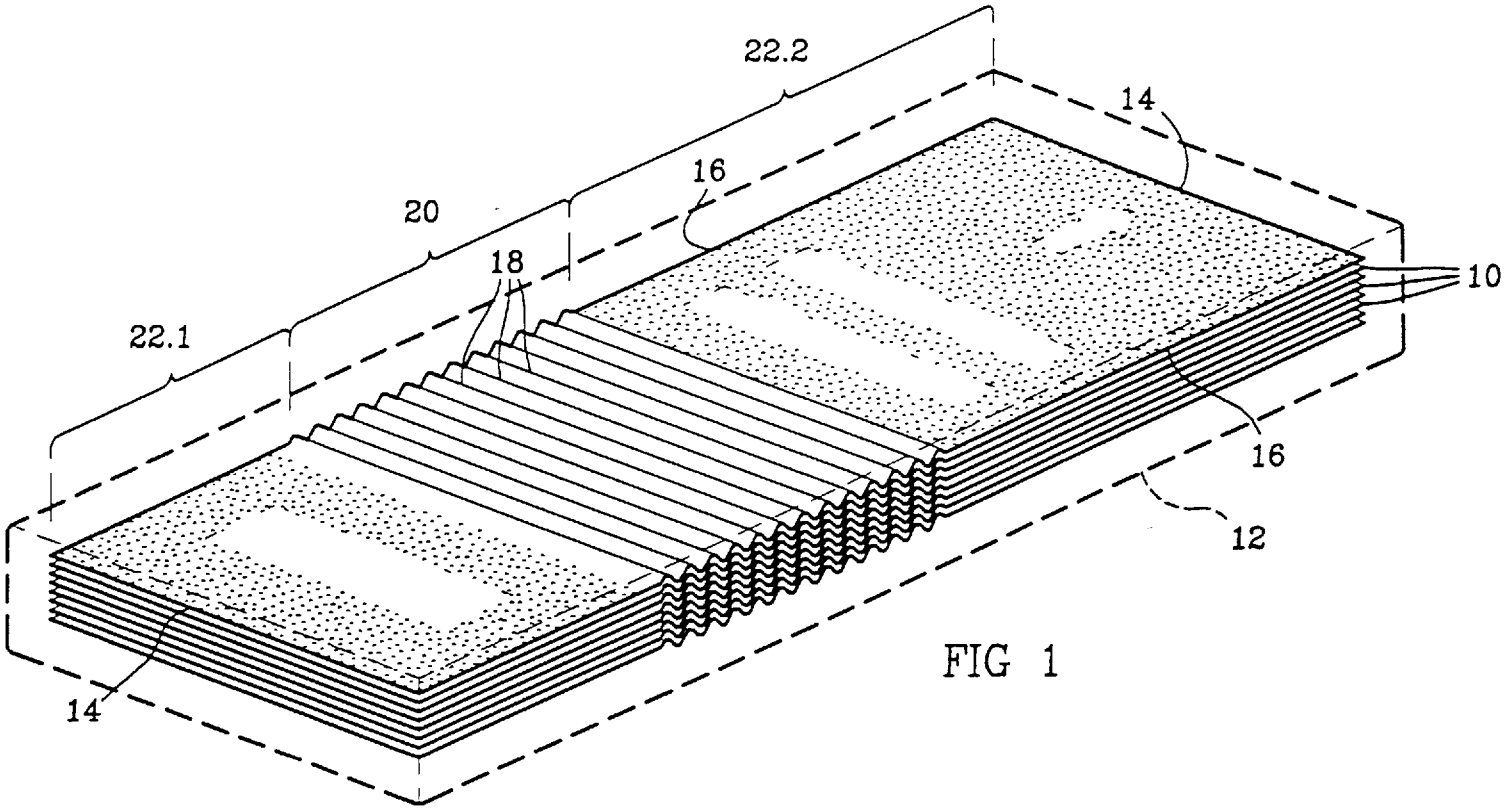
FIG. 1 is a side view of a pictorial view of a pack of foil cuts in accordance with the invention.

Referring now to the drawings in more detail, reference numeral 10 indicates a series of foil cuts stacked one on top of the other and enclosed in a container such as an envelope 12 (shown dotted) or cardboard box to form a pack.

Each of the foil cuts 10 comprises a rectangular sheet of metal foil having a pair of opposite end edges 14 and a pair of opposite side edges 16. Each foil cut 10 further has a series of spaced, parallel corrugations 18 in a corrugated central portion 20 of the foil cut, the corrugations 18 extending from one of the side edges 16 to the other. Between the corrugated portion 20 and the end edges 14 there are uncorrugated portions 22.1 and 22.2 respectively.

The foil cuts 10 may conveniently be of aluminium foil, each having a size of approximately 100 by 250 mm. The length of the corrugated portion 20 may be approximately 60 mm, and the lengths of the uncorrugated portions 22.1 and 22.2 may be 70 and 120 mm respectively. The spacing between adjacent corrugations (crest to crest) may be approximately 5 mm, and the depth of the corrugations (crest to trough) may be in the order of 2 mm.

Figure 2:
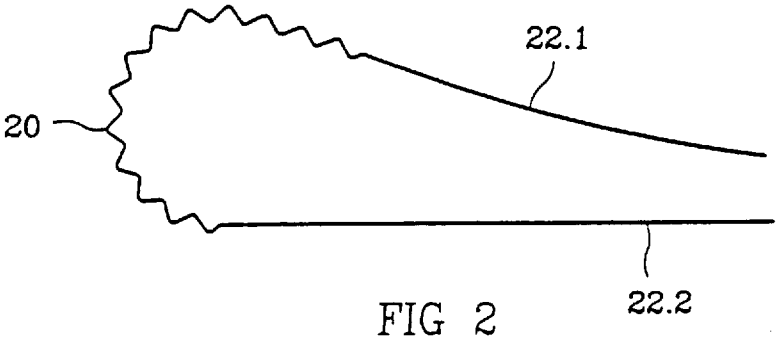
FIG. 2 is a side view of one of the foil cuts, showing its configuration during use.

During use, foil cuts are required to be folded over double so that streaks of hair to which a hair treating preparation has been applied is enveloped between the opposite ends of the foil cut. A major difficulty with conventional foil cuts, i.e. foil cuts which are of flat aluminium foil and do not have any corrugations, is that they are difficult to fold neatly because of their tendency to buckle or crinkle and not fold where the user wants them to fold. The foil cuts of the present invention, on the other hand, are very easy to fold in the region of the corrugated portion 20. A further benefit is that, when folding the foil cuts 10, the corrugated portion 20 bends smoothly to form a gradual curve rather than a sharp fold, as shown in FIG. 2. This leaves the treated streaks of hair which are between the ends of the foil cut 10 more exposed to air, enhancing the effect of the preparation in cases where the preparation relies for its effect on the presence of air.

The foil cuts 10 may conveniently be made by passing aluminium foil strips through the nip of a pair of embossing rollers which are shaped to form the corrugations 18 in the strip. Furthermore, the embossing rollers may be such as to emboss the uncorrugated portions 22.1 and 22.2 to give them easier to handle. Furthermore, by means of the embossing rollers, directions or instructions for use, and/or promotional or advertising material may be embossed on the foil in the uncorrugated portions.

What is claimed is:

1. A foil cut which comprises a strip of metal foil having a pair of opposite end edges, a pair of opposite side edges and a series of spaced parallel corrugations which extend from one of the side edges to the other of the side edges in a central portion of the foil cut, and the foil cut further having uncorrugated portions between the central portion and each said end edge.

2. A pack which comprises a stack of foil cuts as claimed in claim 1, wherein the foil cuts are stacked one on top of the other and enclosed in a container.

3. A foil cut as claimed in claim 1, wherein the uncorrugated portions are embossed.

4. A pack which comprises a stack of foil cuts as claimed in claim 3, wherein the foil cuts are stacked one on top of the other and enclosed in a container.

* * * * *